US011065493B2

(12) United States Patent
Reese

(10) Patent No.: US 11,065,493 B2
(45) **Date of Patent: *Jul. 20, 2021**

(54) PLYOMETRIC FITNESS PLATFORM WITH CONSTRAINED ADJUSTABILITY

(71) Applicant: Perform-X Training Systems, Inc., Lakewood, CO (US)

(72) Inventor: Nicholas Reese, Lakewood, CO (US)

(73) Assignee: PERFORM-X TRAINING SYSTEMS, INC., Lakewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/386,081

(22) Filed: Apr. 16, 2019

(65) Prior Publication Data

US 2019/0308050 A1 Oct. 10, 2019

Related U.S. Application Data

(63) Continuation of application No. 15/160,849, filed on May 20, 2016, now Pat. No. 10,286,244.

(51) Int. Cl.
*A63B 5/16* (2006.01)
*A63B 21/00* (2006.01)
(Continued)

(52) U.S. Cl.
CPC ..... *A63B 5/16* (2013.01); *A63B 6/00* (2013.01); *A63B 21/00061* (2013.01); *A63B 21/00065* (2013.01); *A63B 21/00069* (2013.01); *A63B 21/0442* (2013.01); *A63B 21/0557* (2013.01); *A63B 21/16* (2013.01); *A63B 21/4009* (2015.10); *A63B 21/4043* (2015.10); *A63B 2071/0694* (2013.01); *A63B 2225/09* (2013.01); *A63B 2244/08* (2013.01)

(58) Field of Classification Search
CPC ..... A63B 5/16; A63B 6/00; A63B 21/00069; A63B 21/00061; A63B 21/00065; A63B 21/0442; A63B 21/0557; A63B 21/16; A63B 21/4009; A63B 21/4043; A63B 2071/0694; A63B 2225/09; A63B 2244/08
See application file for complete search history.

(56) References Cited

U.S. PATENT DOCUMENTS 4,968,028 A * 11/1990 Wehrell ..... A63B 5/16 482/124
5,512,029 A * 4/1996 Barnard ..... A63B 21/0552 482/124
(Continued)

*Primary Examiner* — Megan Anderson
(74) *Attorney, Agent, or Firm* — Cochran Freund & Young LLC; Regan L. Trumper

(57) ABSTRACT

Disclosed are systems and methods for plyometric fitness systems that facilitate constrained multi-directional movements. By utilizing a variety of constrained elastic resistance cords in conjunction with plyometric platform stations and performance patterns, this system enhances dimension, capability and variety to conventional agility and jumping drills. The disclosed plyometric platforms are designed for contrast training, or resistance loaded and unloaded exercises. This allows the muscles to adapt to the loaded exercises and then apply the "learned" movement to the unloaded exercise. This directly reinforces the movement and muscle exertion needed to perform powerful movements thereby enhancing athletic performance.

16 Claims, 8 Drawing Sheets

(51) Int. Cl.

| | |
|---|---|
| ***A63B 21/04*** | (2006.01) |
| ***A63B 21/055*** | (2006.01) |
| ***A63B 21/16*** | (2006.01) |
| ***A63B 6/00*** | (2006.01) |
| *A63B 71/06* | (2006.01) |

(56) References Cited

U.S. PATENT DOCUMENTS

| | | | | |
|---|---|---|---|---|
| 6,202,263 | B1 * | 3/2001 | Harker | B62J 7/08 114/230.2 |
| 6,220,994 | B1 * | 4/2001 | Rich | A63B 21/0004 482/123 |
| 6,299,569 | B1 * | 10/2001 | Rich | A63B 21/0004 482/121 |
| 7,431,681 | B1 * | 10/2008 | St. Cyr | A63B 21/0552 482/121 |
| 7,494,453 | B2 * | 2/2009 | Wehrell | A63B 21/055 482/124 |
| 8,317,660 | B2 * | 11/2012 | Goranson | A63B 21/4037 482/23 |
| 9,199,110 | B2 * | 12/2015 | Jones | A63B 23/047 |
| 9,259,603 | B2 * | 2/2016 | Wireman | A63B 71/023 |
| 2007/0087920 | A1 * | 4/2007 | Dachraoui | A63B 21/0552 482/123 |
| 2010/0081549 | A1 * | 4/2010 | Thompson | A63B 5/11 482/27 |
| 2017/0232302 | A1 * | 8/2017 | Dedvukaj | A63B 22/16 482/123 |

* cited by examiner

PLYOMETRIC FITNESS PLATFORM WITH CONSTRAINED ADJUSTABILITY

BACKGROUND OF THE INVENTION

Elastic bands, also known as resistance bands, are commonly used in physical therapy and strength training. These bands were originally made from surgical tubing and the exercises conducted for muscle rehabilitation. Currently resistance band training is now used widely as part of general fitness and strength training. Their flexibility in use and lightweight afford them versatility, portability and low-cost. Simple to use, and lightweight, people can easily transport or travel with these bands to provide an extremely portable training system.

Typically, these elastic bands are used for isometric and isokinetic resistance exercises between anchored or grasped ends. The elastic stretch provides resistance through range of motion mimicking weight training. The downside to these devices includes a lack of anchoring to stable surfaces which facilitates instability with the user, and the inability to isolate particular muscle groups and movements.

Anchored elastic training systems for providing fitness and performance training have been previously contemplated, but have fallen short in providing an optimal environment for maximizing training and safety.

SUMMARY OF THE INVENTION

An embodiment of the present invention may therefore comprise: a plyometric fitness system for facilitating constrained multi-directional movements of a user comprising: a training platform placed on or within a floor section upon which a user is able to stand and perform multi-directional exercise movements; at least one anchor track system fixated adjacent to the training platform; at least one elastic cord that attaches on a proximal end to a body attachment strap fixed to a body part of the user, and at a distal end to the track anchoring system; at least one quick-release anchor that facilitates adjustable attachment at multiple points on the anchor track to provide fixation of the distal end of the elastic cord with respect to the training platform, thereby providing the constraint for the multi-directional movements of a user; and, an exercise pattern design on the platform that comprises a plurality of targets that are visible to the user during the movements, the targets that act as start-points or end-points for body parts undertaking the movements.

An embodiment of the present invention may also comprise: a plyometric fitness system for facilitating constrained multi-directional movements of a user comprising: a training platform placed on or within a floor section upon which a user is able to stand and perform multi-directional exercise movements, the platform that incorporates at least one anchor track system fixated adjacent to the platform, the receptacle strip that provides multi-point attachment of the quick-release anchor in a linear manner flanking at least one side of the training platform; at least one elastic cord that provides stretching capability encased within a fabric sleeve and attaches with a first connector at a proximal end to a body attachment strap fixed to a body part of the user, and attaches with a second connector at a distal end to the track anchoring system via at least one quick-release anchor, the at least one quick-release anchor that facilitates adjustable attachment at multiple points on the anchor track to provide fixation of the distal end of the elastic cord with respect to the platform; an exercise pattern design on the platform that comprises a plurality of targets that are visible to the user during the movements, the targets that act as start-points or end-points for body parts undertaking the movements; a predetermined program of body movements that are performed by the user that coordinate and sequence elastically constrained jumping movements between the targets utilizing the elastic cords as the constraint, the program that incorporates a forced eccentric contraction to the muscles which is immediately shifted to a concentric contraction as the athlete performs the jumping movements.

An embodiment of the present invention may also comprise: a method of enhancing performance capabilities of a user by performing constrained multi-directional movements utilizing a plyometric fitness system comprising the steps: supplying a training platform on or within a floor section upon which a user is able to stand and perform multi-directional exercise movements; supplying an exercise pattern design on the platform that comprises a plurality of targets that are visible to the user during the movements; elastically constraining the user to at least one anchor track system fixated adjacent to the training platform with at least one elastic cord comprising the steps: attaching a proximal end of the at least one elastic cord to a body attachment strap; fixating the body attachment strap to a body part of the user; attaching a distal end of the at least one elastic cord to the track anchoring system with at least one quick-release anchor that facilitates adjustable attachment at multiple points on the track anchoring system to provide fixation of the distal end of the elastic cord with respect to the training platform, thereby constraining for the multi-directional movements of a user; and, performing a series of predetermined plyometric movement drills initiating at start-points within the exercise pattern design, the drills comprising a program of consecutive body movements that coordinate and sequence elastically constrained jumping movements between the targets utilizing the elastic cords as the constraint; and, forcing an eccentric contraction to the muscles then immediately shifting to a concentric contraction as the user performs the jumping movements.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

In the drawings.

DETAILED DESCRIPTION OF THE INVENTION

Figure 1:
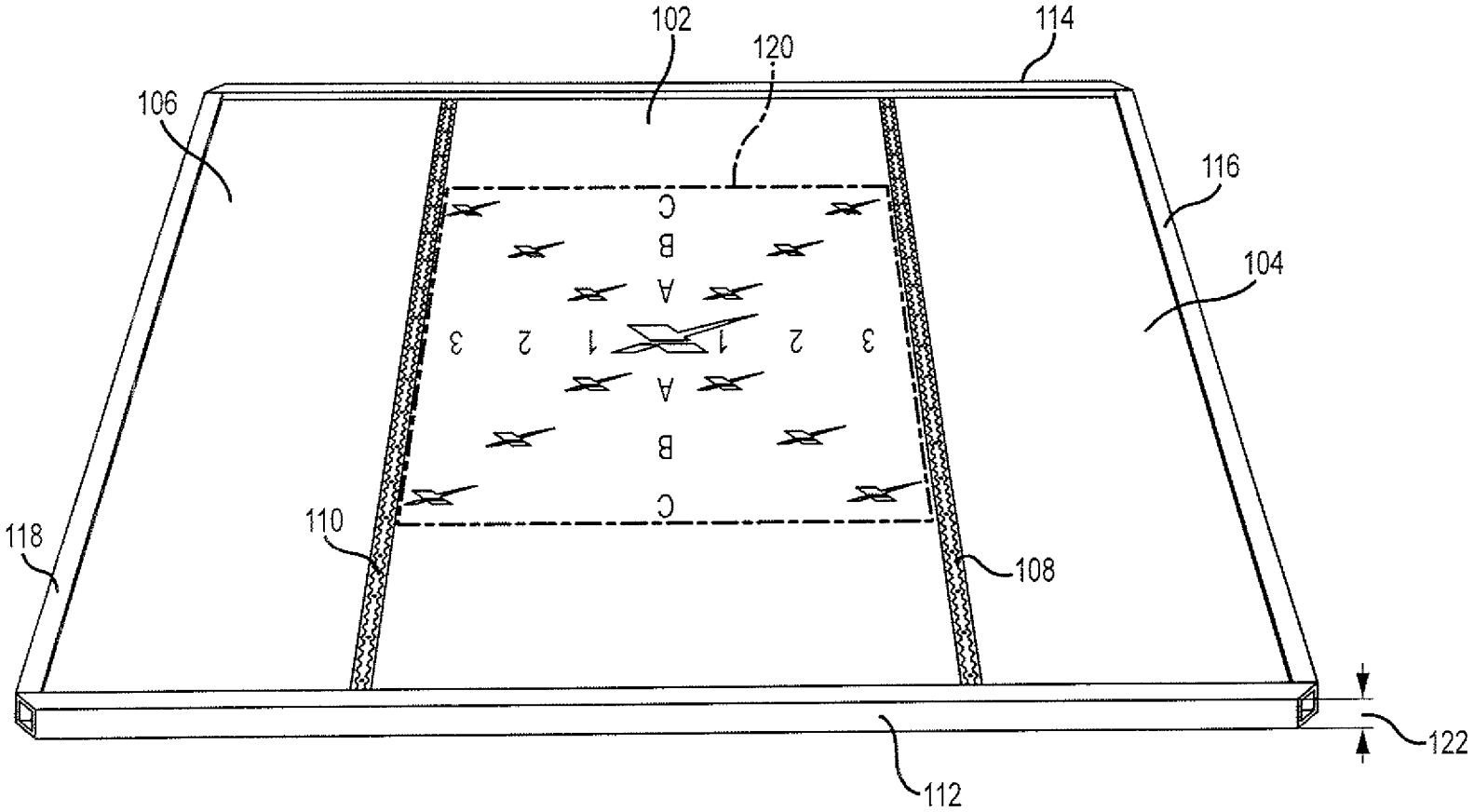
FIG. 1 illustrates a plyometric fitness platform with constrained adjustability.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described. It is also to be understood that the terminology used herein is for the purpose of describing particular embodiments only, and is not intended to be limiting, since the scope of the present disclosure will be limited only by the appended claims.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

As will be apparent to those of skill in the art upon reading this disclosure, each of the individual embodiments described in illustrated herein as discrete components and features which may be readily separated from or combined with the features of any of the other several components without departing from the scope or spirit of the present disclosure. Any recited method can be carried out in the order of events recited, or in any other order that is logically possible.

The disclosed apparatus overcomes the current limitations by presenting a system for enhancing the environment of anchored elastic training systems that provide rehabilitation, fitness and performance training by providing an optimal platform for maximizing training and safety.

FIG. 1 illustrates a plyometric fitness platform with constrained adjustability. As shown in FIG. 1, this example of a fitness platform comprises three platform surfaces. The center platform surface 102 contains the exercise pattern 120 upon which the plyometric fitness exercises are performed. This center platform surface 102 is flanked by a left lateral platform surface 104 and a right lateral platform surface 106. Dividing each of these platform surface sections is a track mechanism for anchoring one end of elastic resistance bands that are secured on the other end to the user. A left anchor track 108 separates the left lateral platform surface 104 from the center platform surface 102, and the right anchor track 110 separates the center platform surface 102 from the right lateral platform surface 106.

The three platform surfaces 102-106 with the anchor tracks 108-110 are circumferentially bounded and retained by a frame mechanism. This includes lateral retention utilizing a left frame 116, a right frame 118, and front to back retention utilizing a front frame 112 and a rear frame 114. These components are fixated to provide stability to the user for performing a variety of athletic exercises on the platform surface. The plyometric platform can be made in a variety of thickness to provide a platform height 122 that will meet the performance needs of the exercise to be performed on the surface, as well as integrating into a fitness environment as a surface mount or as an apparatus that is inlaid into the flooring surface thus, providing a constant floor height.

Figure 2:
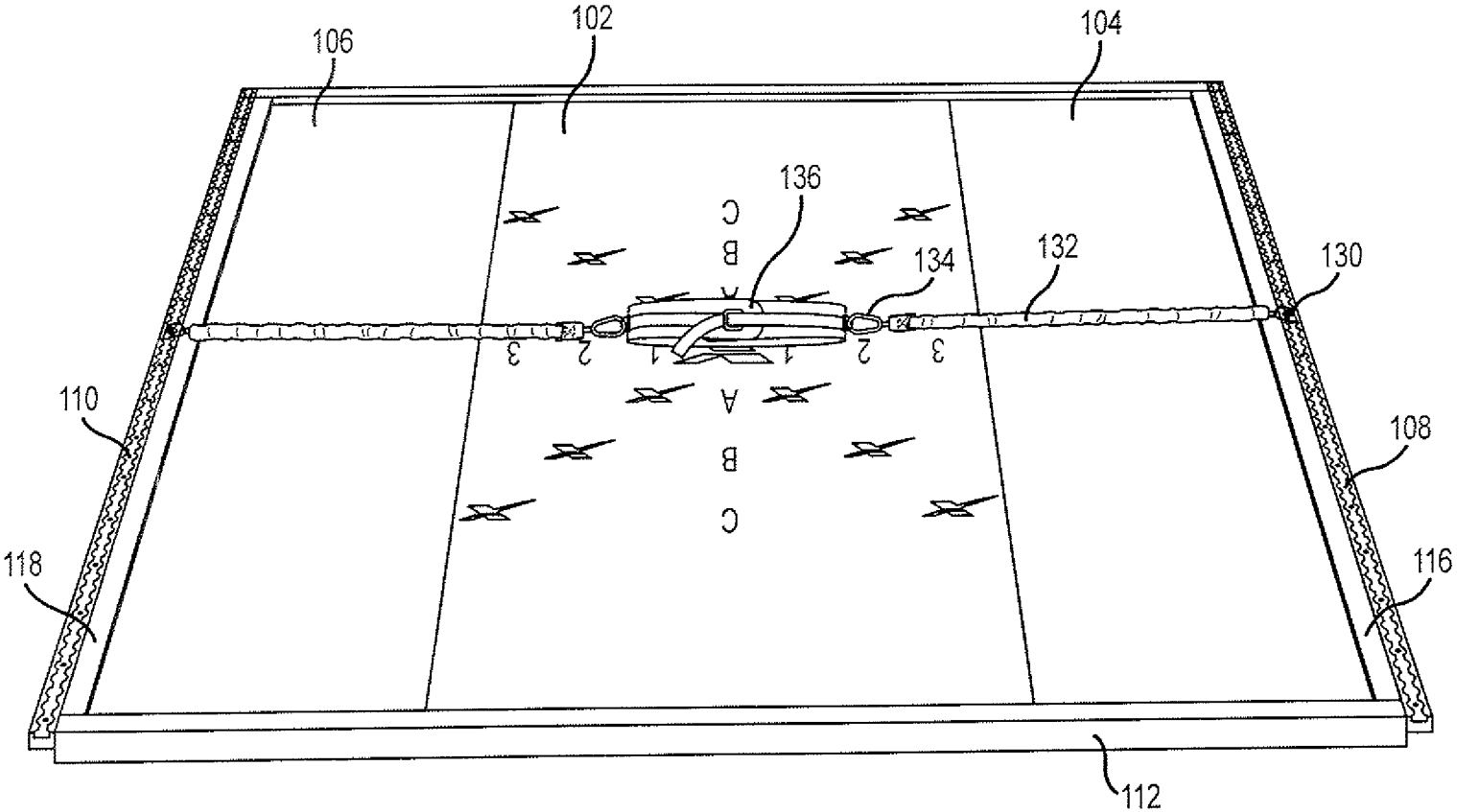
FIG. 2 illustrates another embodiment of a plyometric fitness platform with constrained adjustability.

FIG. 2 illustrates another embodiment of a plyometric fitness platform with constrained adjustability. As shown in FIG. 2, this example of a fitness platform also comprises three platform surfaces. The center platform surface 102 contains the exercise pattern 120 upon which the plyometric fitness exercises are performed. This center platform surface 102 is flanked by a left lateral platform surface 104 and a right lateral platform surface 106. On the outside edge of each of the lateral platform surfaces 104, is a track mechanism for anchoring one end of elastic resistance bands that are secured on the other end to the user. A left anchor track 108 lies laterally to the left lateral platform surface 104, and the right anchor track 110 lies laterally to the right lateral platform surface 106. In his embodiment, the adjustable anchor 130 that attaches the distal end of the flex resistance band 132 to the platform is secured at a greater distance from the user providing greater lateral angle resistance when performing plyometric exercises. The proximal end of the flex resistance band is attached to the user utilizing a body attachment strap 136 connected to a band fastener 134 (typically a releasable fastener) to the flex resistance band 132.

Typically, the flex resistance bands 132 are placed in pairs on opposing sides of the user to provide symmetric resistance from a center point on the center platform surface 10. For example, a single pair of flex resistance bands 132 may be anchored along a lateral centerline of the platform (as exemplified in FIG. 3) or may be anchored along a the front or rear corners of the platform (as exemplified in FIG. 4). Multiple pairs may also be used in an opposing manner to provide a variety of resistance options for the plyometric workout depending upon the individual needs and goals of the user.

In this embodiment, the three platform surfaces 102-106 are circumferentially bounded and retained by a frame mechanism with the anchor tracks 108-110 mounted on the outside of the frame. This frame includes lateral retention utilizing a left frame 116, a right frame 118, and front to back retention utilizing a front frame 112 and a rear frame 114. These components are fixated to provide stability to the user for performing a variety of athletic exercises on the platform surface. The plyometric platform can also be integrating into a fitness environment as a surface mount or as an apparatus that is inlaid into the flooring surface thus, providing a constant floor height. As an integrated apparatus, this embodiment may be placed on top of a structural floor, inlaid into a recessed floor surface, or even elevated to accommodate a variety of situations and environments.

Figure 3:
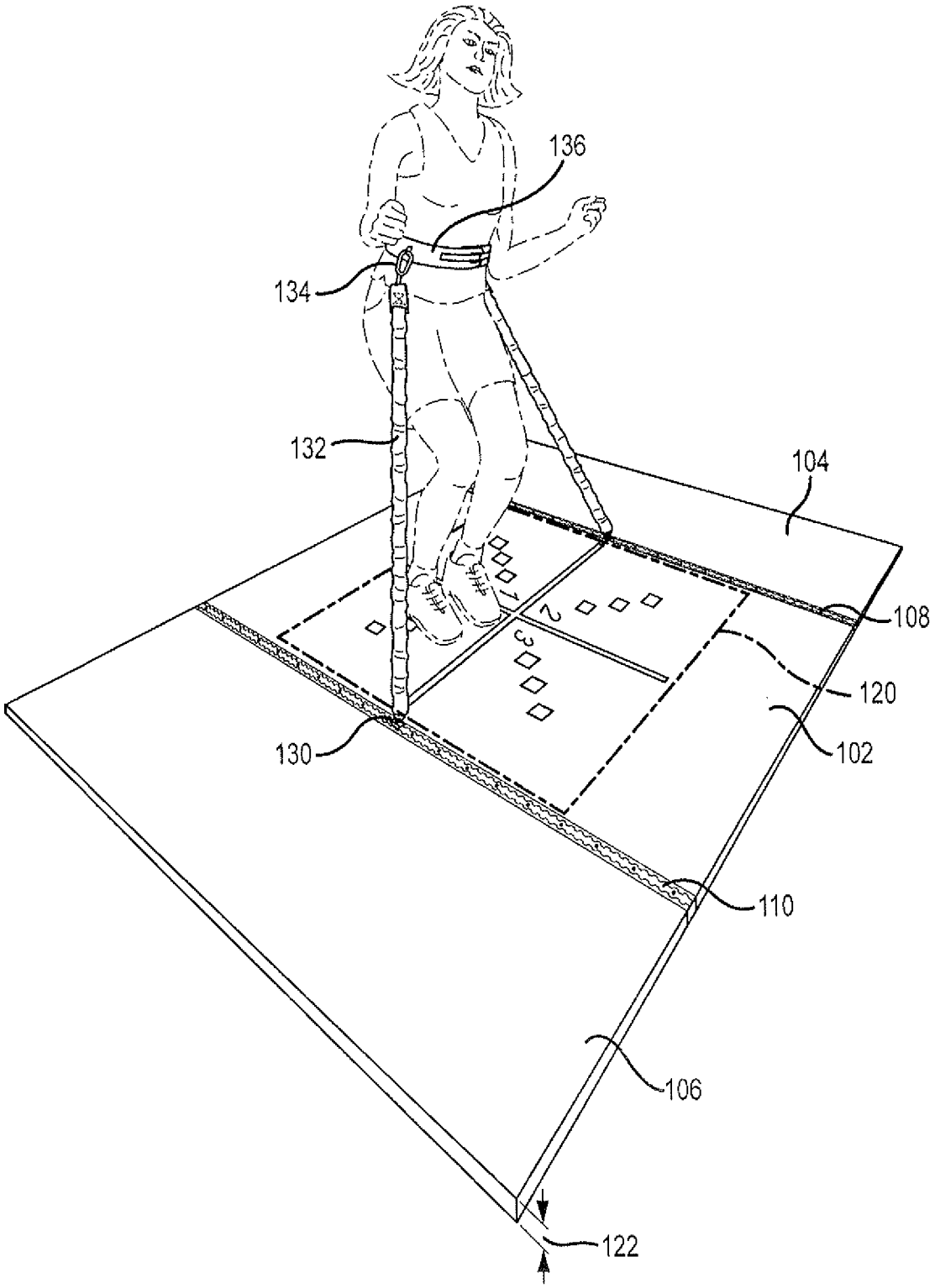
FIG. 3 illustrates yet another embodiment of a plyometric fitness platform with constrained adjustability.

FIG. 3 illustrates a plyometric fitness platform with constrained adjustability being utilized by an athlete. As shown in FIG. 3, this example, in a similar manner as was disclosed above, the fitness platform comprises three platform surfaces. The center platform surface 102 contains the exercise pattern 120 upon which the plyometric fitness exercises are performed. This center platform surface 102 is flanked by a left lateral platform surface 104 and a right lateral platform surface 106. Dividing each of these platform surface sections is a track mechanism for anchoring one end of elastic resistance bands that are secured on the other end to the user. A left anchor track 108 separates the left lateral platform surface 104 from the center platform surface 102, and the right anchor track 110 separates the center platform surface 102 from the right lateral platform surface 106.

In this embodiment, the three platform surfaces 102-106 with the anchor tracks 108-110 are not circumferentially bounded or retained by a frame mechanism. This facilitates an inlay mounting where the platform surfaces 102-106 are aligned (placed at the same horizontal height) as the flooring of the workout area. This provides a stable, safe and functional workout environment with a constant floor height that allows easy access in an unobtrusive manner. The plyometric platform in this embodiment may also be made in a variety of thicknesses to provide a platform height 122 that will meet the performance needs of the exercise to be performed, as well as matching the flooring surface height.

As illustrated in FIG. 3, a user is attached to the plyometric fitness apparatus utilizing a pair of flex resistance bands 132. Whereas this example demonstrates the use of a single pair of flex resistance bands 132, multiple pairs or single bands may be utilized for specific exercises tailored to enhance specific fitness or performance goals. In this embodiment, the flex resistance bands 132 are anchored at an adjustable point anywhere along the anchor track utilizing an adjustable anchor 130 and are secured at the other end to a body attachment strap 136 utilizing band fasteners 134 and are placed around the waist or hips of the user. The athlete begins the fitness training in a stationary starting point, typically, but not exclusively at the center of the exercise pattern 120. The user will then typically hop or bound from the starting (center) to a variety of positions laid out in the exercise pattern 120. The athlete will bound back and forth through various patterns while being resisted in those motions by the resistance bands 132.

This plyometric activity also known as "jump training" allows the body muscles to exert maximum force in short intervals of time, with the goal of increasing power, speed and/or strength. This focuses the training on movement from muscle extension to contraction in a rapid or explosive manner and is designed to uniquely improve athletic performance. Training in this manner brings about a forced eccentric contraction to the muscles which is immediately shifted to a concentric contraction as the athlete jumps upward. By executing the landing and takeoff an extremely short periods of time, the athlete experiences a "shock" (eccentric/concentric contractions) which is an extremely effective method to improve speed, quickness and power after development of a strong strength base.

This plyometric training focuses on quick movements, explosive speed and building a higher vertical jump. With contrast training, athletes can train to to move faster and jump higher by reinforcing movements with loaded/unloaded drills to promote muscle memory. The disclosed plyometric platform system is maximized for contrast training, or resistance loaded and unloaded exercises. This allows the muscles to adapt to the loaded exercises and then apply the "learned" movement to the unloaded exercise. This reinforces the movement and muscle exertion needed to perform powerful movements.

Figure 4:
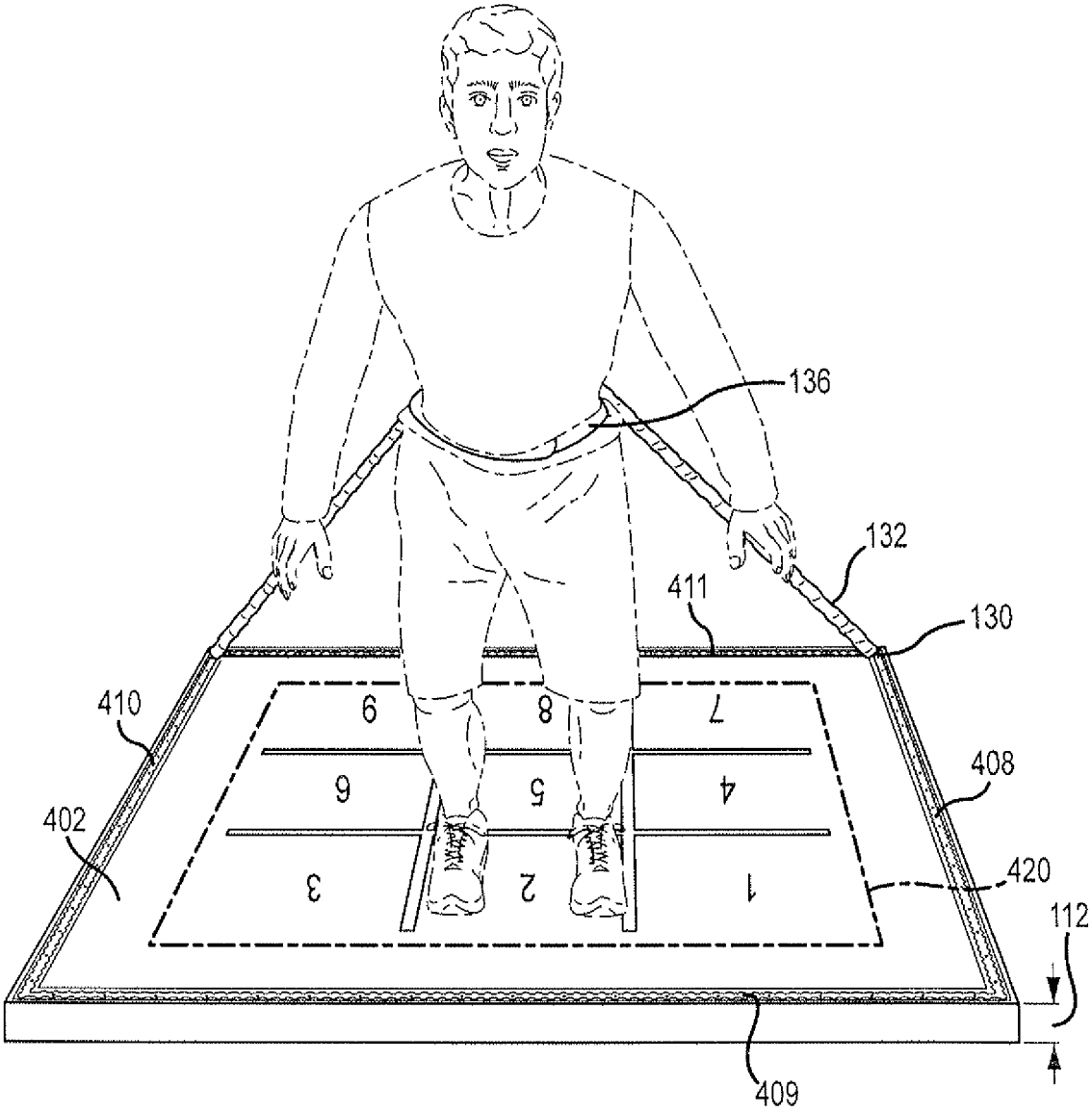
FIG. 4 illustrates yet another embodiment of a plyometric fitness platform with constrained adjustability.

FIG. 4 illustrates another plyometric fitness platform with constrained adjiustability being utilized by an athlete. In a similar manner as was disclosed in FIG. 3, with the exception that the fitness platform comprises a single platform surface 402, which contains the exercise pattern 420 upon which the plyometric fitness exercises are performed. This platform surface 402 is flanked by a track mechanism for anchoring the ends of the elastic flex resistance bands 132 that are secured on the other end to the user. A left anchor track 408 and a right anchor track 410 flank the center platform surface 402, and a front anchor track 409 and a rear anchor track 411 bound the center surface on the anterior and posterior sides.

In this embodiment, the single platform surface 402 is circumferentially encircled by the anchor tracks 408-410. This facilitates inlay mounting where the platform surface 402 is aligned (placed at the same horizontal height) as the flooring of the workout area. This provides a stable, safe and functional workout environment with a constant floor height that allows easy access in an unobtrusive manner. This embodiment also facilitates surface or elevated mounting where the platform surface 402 is placed upon the flooring of the workout area. The plyometric platform in this embodiment may also be made in a variety of thicknesses to provide a platform height 122 that will meet the performance needs of the exercise to be performed, as well as the ability to match the flooring surface height.

In the example illustrated in FIG. 4, a user is attached to the plyometric fitness apparatus utilizing a pair of flex resistance bands 132. Whereas this example demonstrates the use of a single pair of flex resistance bands 132, multiple pairs or single bands may be utilized for specific exercises tailored to enhance specific fitness or performance goals. In this embodiment, the flex resistance bands 132 are anchored at an adjustable point anywhere along the anchor track utilizing an adjustable anchor 130 with the other end of the flex resistance bands 132 being secured to a body attachment strap 136 utilizing band fasteners 134 and are placed around the waist or hips of the user.

The athlete begins the fitness training in a stationary starting point, in this example at the posterior center of the exercise pattern 120. In this type of plyometric movement, the user will hop or bound from a starting point to a variety of positions laid out in the exercise pattern 120. The athlete will bound back and forth through various patterns while being resisted in those motions by the resistance bands 132 which are preferentially positioned to load the user with an increased posterior weighting. Thus, since the resistance bands 132 are anchored on the posterior portion of the left and right anchor tracks 408, 410, forward (anterior) movements of the user are subject to greater resistance than movements to the rear (posterior) movements. This type of adjustment allows for specificity training thereby concentrating resistance to muscle groups which are involved with forward motions. In a similar manner, the resistance bands 132 may be positioned on the anterior portion of the left and right anchor tracks 408, 410, providing greater resistance to movements to the rear (posterior).

Utilizing a variety of constrained elastic resistance cords in conjunction with the plyometric platforms adds additional dimension, capability and variety to conventional agility and jumping drills. The plyometric platforms are designed for contrast training, or resistance loaded and unloaded exercises. This allows the muscles to adapt to the loaded exercises and then apply the "learned" movement to the unloaded exercise. This reinforces the movement and muscle exertion needed to perform powerful movements thereby enhancing athletic performance.

Figure 5:
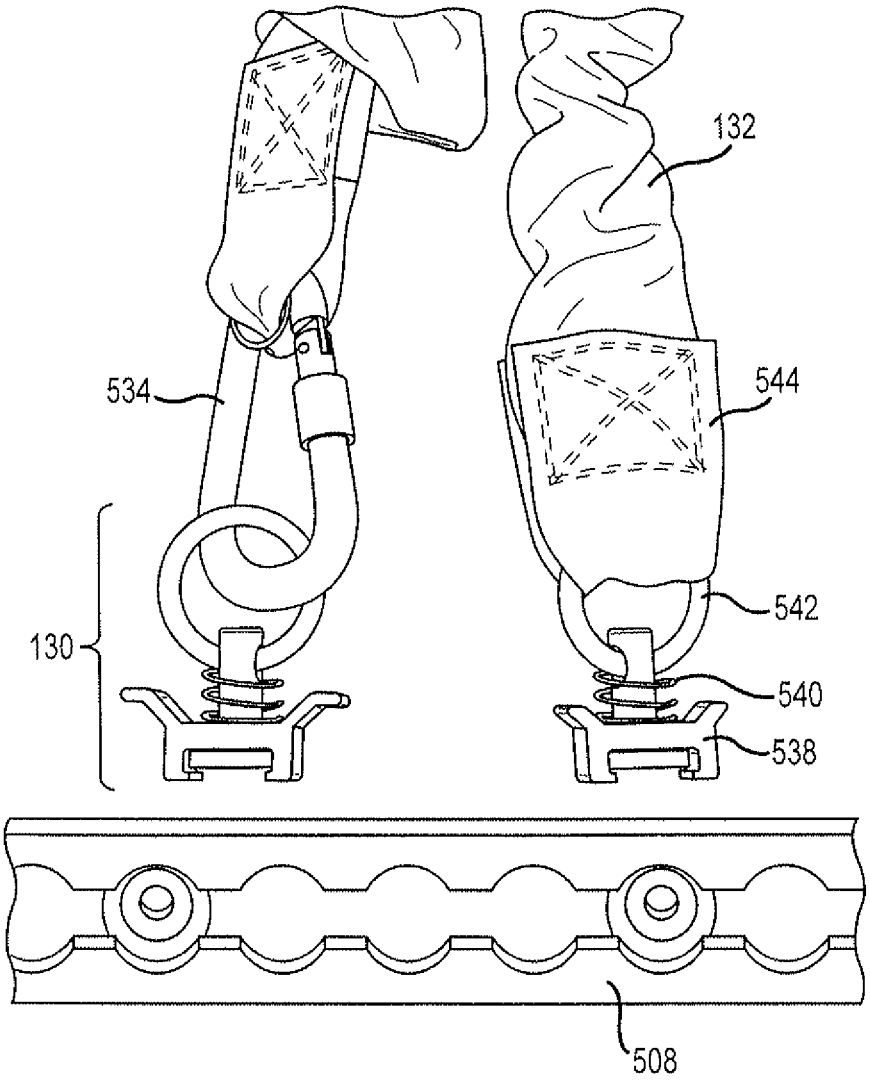
FIG. 5 illustrates an embodiment of an example of an anchor track and locking mechanisms for adjustably securing elastic bands at various points on the anchor track.

FIG. 5 illustrates an embodiment of anchor and locking mechanisms for adjustably securing elastic bands at various points along the perimeter of a plyometric fitness platform. In this example, an anchor track 508 is rigidly secured relation to the fitness platform typically in a circumferential manner. The disclosed track system adjustably mates with, an anchors the band utilizing an adjustable anchor 130, which provides a quick release mechanism for the resistance band 132. In this example, the flex resistance band 132 is connected to a ring 542 or band fastener 534 (quick release mechanism) utilizing a terminus 544 that is permanently connects the two pieces (typically sewn and/or glued).

This embodiment utilizes adjustable comprises ring 542 section that is connected to a fixator 538. A spring 540 is utilized to preferentially load the fixator 538 to extend outwardly from the ring 542 such that when the fixator 538 is placed within the anchor track 508 it will lock in place with relation to the openings of the track. Thus, the adjustable anchor 130 can be easily and quickly retained within the anchor track 508 at any one of the circular opening positions found within the length of the track. This facilitates a quick release to the highly adjustable positioning of the flex resistance bands anywhere within the perimeter of the plyometric fitness platform. This quick, highly adjustable anchoring allows the user to perform a variety of plyometric exercises in a self-contained, compact area, which is highly versatile in the type and extent of resistance that is placed upon the individual performing the activities.

Figure 6:
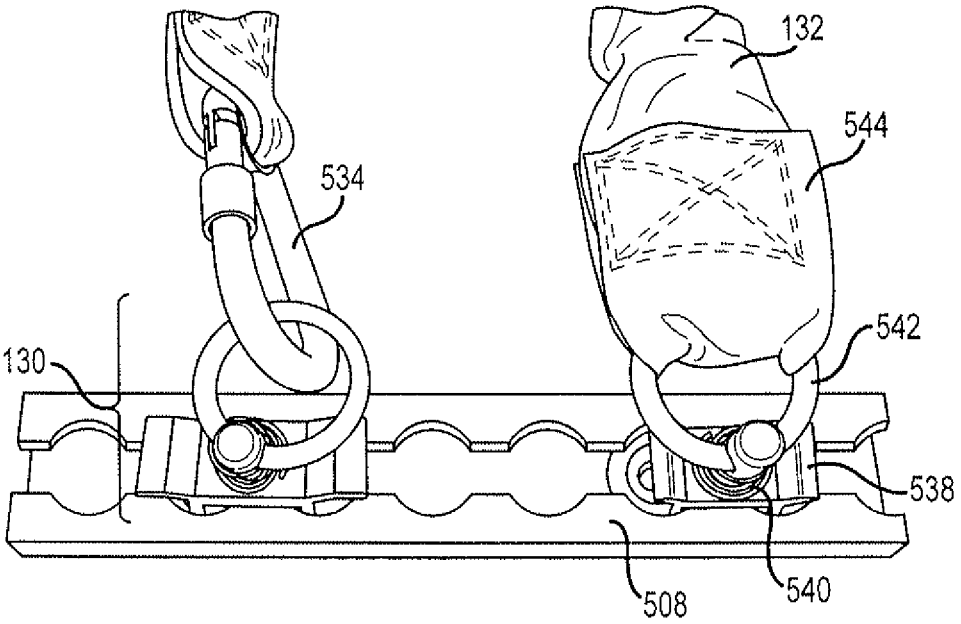
FIG. 6 illustrates an embodiment of an example of an anchor track and locking mechanisms with elastic bands secured on the anchor track.

FIG. 6 further illustrates an embodiment of anchor and locking mechanisms for adjustably securing elastic bands at various points along the perimeter of a plyometric fitness platform as was detailed in FIG. 5. This example shows the anchor mechanism 130 placed within, and anchored to the anchor track 508. As shown in FIG. 6, the left resistance band 132 is secured to the fixed anchor mechanism 130 with a quick release band fastener 534 to facilitate removal of the flex band 132 from the anchor point. The resistance band 132 shown on the right is secured to the fixed anchor mechanism 130 with a non-releasable means that does not allow removal of the flex band 132 from the adjustable anchor 130. As is shown the example of FIG. 6, a multitude of resistance bands may be anchored to a length of tracking in a variety of positions facilitating a high degree of versatility and flexibility in training resistance.

Figure 7:
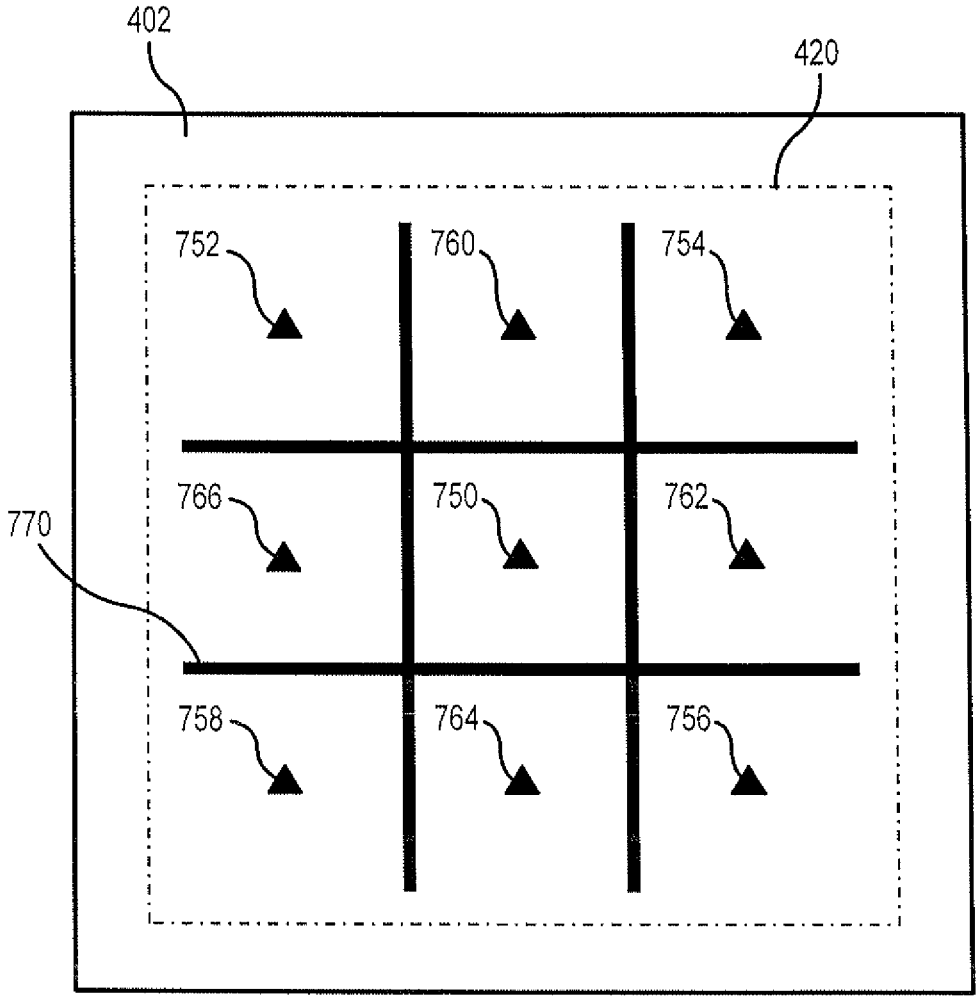
FIG. 7 illustrates an embodiment of a single-stage plyometric fitness pattern.

FIG. 7 illustrates an embodiment of a single-stage plyometric fitness pattern 420. As shown in the disclosed example, a symmetric grid pattern is segmented into (in this case) nine separate zones delineated by a grid pattern 770 and displayed upon a plyometric platform surface 402. Each of the zones additionally displays a target 752-766 that the user will use to perform movements (resisted jumps) in order to complete a plyometric fitness routine.

The disclosed floor pattern offers lower body multi-directional movement applications with specific anchoring opportunities through the anchor track. Progressive floor drills and flexible resistance bands 132 provide resistance opportunities that offer the user a variety of applications for the improvement of quickness, agility, power and jumping ability. In plyometric applications, the muscle and tendons are put in a pre-stretch followed by an explosive contraction (stretch reflex). The rate or speed of the stretch is equal to the rate of the resulting muscle contraction. Utilizing the disclosed methods and apparatus, the plyometric fitness platform system allows individuals the opportunity to enhance the stretch reflex mechanism through sophisticated programming and intelligent progressions.

With the pattern exemplified in FIG. 7, a user may be elastically fixated with flexible resistance bands 132 attached from a waist harness (e.g., body attachment strap 136) to one of more pairs of anchor positions located on the perimeter of the exercise pattern 420. Typically, this will be centered laterally or additionally with front and back bands, or optionally at all four corners. In this manner, the user is fixated to the center point which in this case is positioned at target 750. With the user standing the center point, jumping movements may be initiated front to back by jumping from target 750, to 760, to 750, to 764, returning to 750 and/or laterally for example from target 750, to 766, to 750, to 762, returning to 750. The user may also perform movements diagonally with disclosed pattern with the user standing the center point, and jumping initiated from target 750, to 754, to 750, to 758, returning to 750 and/or from target 750, to 752, to 750, to 756, returning to 750.

Figure 8:
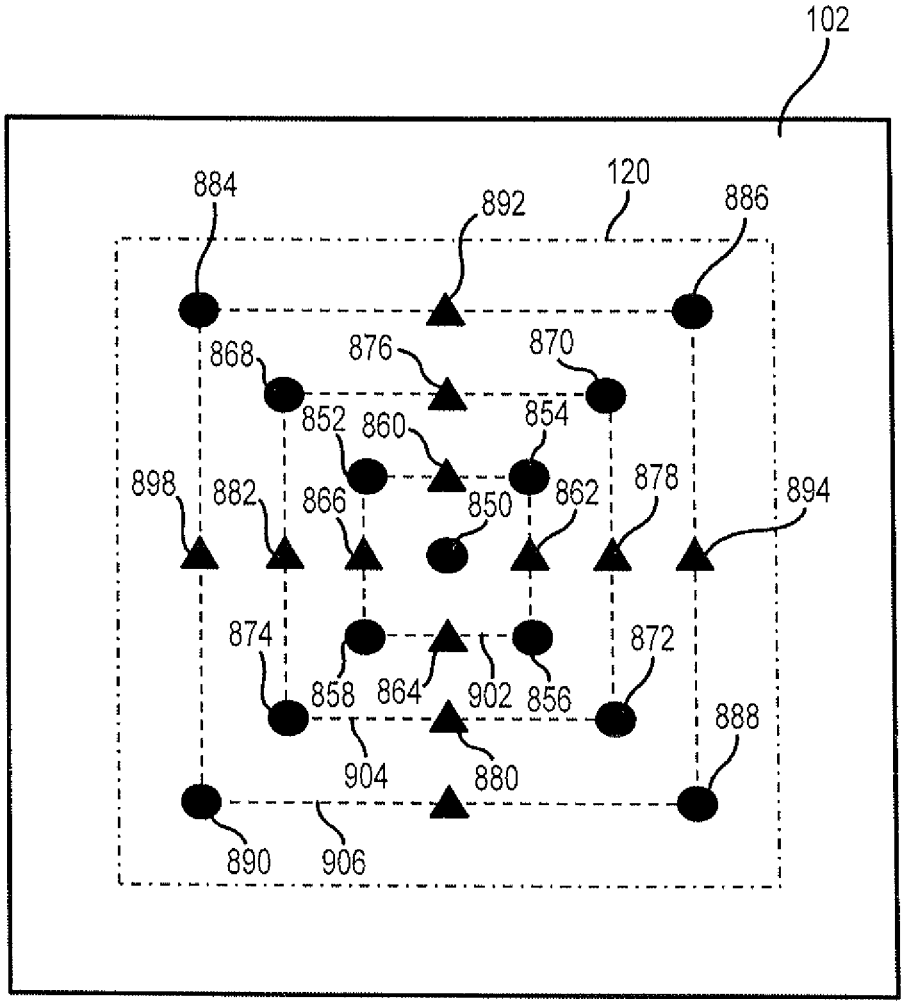
FIG. 8 illustrates an embodiment of a multi-stage plyometric fitness pattern.

FIG. 8 illustrates an embodiment of a multi-stage plyometric fitness pattern 120. As shown in the disclosed example, a symmetric grid pattern is segmented into (in this case) three stages (difficulty/intensity levels), each comprising nine separate zones delineated and displayed upon a plyometric platform surface 102. The embodiment disclosed in this example for stage 1 (level 1) is similar to that disclosed in FIG. 7 with the nine targets 850-866 of stage 1 902 comprising the lateral/front-to-back pattern 860-866 (shown as triangles) and the diagonal patterns 852-558 (shown as circles) that the user will use to perform movements (resisted jumps) in order to complete a plyometric fitness routine.

Additionally, this particular exercise pattern 120 comprise a second stage 904 (level 2 difficulty) that provides an additional series of eight targets 868-882 that are spaced at a greater distance from the center point 850. A third stage 906 is provided in a similar manner for an additional series of eight targets 884-989 that are spaced at an even greater distance from the center point 850 for maximizing the effort (difficulty) of the plyometric routine.

With the pattern exemplified in FIG. 8, a user may be elastically fixated with flexible resistance bands 132 attached from a waist harness (e.g., body attachment strap 136) to one of more pairs of anchor positions located on the perimeter of the exercise pattern 120. Typically, this will be centered laterally or additionally with front and back bands, or optionally at all four corners. In this manner, the user is fixated to the center point which in this case is positioned at target 850. With the user standing the center point, jumping movements (also referred to a pattern drills) may be initiated front to back at various intensity levels (stage 1 902, stage 2 904, stage 3 906) by jumping for example from stage 1 902 targets 850, to 860, to 850, to 864, returning to 850 and/or laterally for example from target 850, to 866, to 850, to 862, returning to 850. The user may also perform stage 1 (light effort) movements diagonally with disclosed pattern with the user standing the center point, and jumping initiated from target 850, to 854, to 850, to 858, returning to 850 and/or from target 850, to 852, to 850, to 856, returning to 850.

Medium (level 2) effort movements may be performed similarly by utilizing the stage 2 targets 868-882 with the center point 850, and intense (level 3) effort movements may be performed similarly by utilizing the stage 3 targets 884-898 with the center point 850. With this single exercise pattern 120, the user is able to perform a multitude of plyometric exercises and a variety of intensities for specificity of training of a variety of athletes performing at different ability/intensity levels. In addition to the visual pattern displayed physical barriers such as small foam pads, blocks strips or the like may be placed on the plyometric fitness platform in a manner similar to the optical grid 770 exemplified in FIG. 7. This adds an additional level of difficulty and challenge to the plyometric pattern drill forcing the user to maintain a predetermined level of vertical clearance above the barrier when jumping from target to target.

In addition to the flexibility that the anchor track affords the system by allowing easy manipulation of the anchor points, a variety of flex resistance bands 132 may be utilized with the system. By utilizing bands different elasticity, even greater variation to the plyometric training regimen can be realized. For instance, elastic bands within the flex resistance bands 132 may be varied to provide highly flexible (low resistance) or very inflexible (high resistance) resistance to the athlete while performing the exercises, as well as the relative positioning of the anchor point of the flex resistance band 132 within the anchor track 108,508, thereby tailoring the activity to the specific fitness and/or performance needs of the individual. These flex resistance bands 132 typically comprise an elastic member that provides stretching capability (similar to a bungee cord, e.g., stretch-able runner or latex fibers or bands) with a fabric sleeve encasing the elastic bundle. Closed ring and/or releasable (carabiner type) connectors can be incorporated or added to the ends of the bands to affix the band from an anchor point to a body part of the user.

The disclosed plyometric fitness platform system is the only system that combines fundamental footwork progressions with quantified resistance in a variety of platform surfaces including wood, composite, rubber or other polymeric material or the like in either a stand-alone or inlaid flooring model. The exercise pattern sequence coupled with the anchoring track system gives the user scientific periodization from basic single-plane movement, to complex multi-plane movement with quantifiable resistance. The system allows individuals to expand upon the pattern programming to create specific movement patterns based on the user's fitness level, and the individuals sport, activity and/or motion.

The disclosed plyometric fitness platform system fulfills the need of all multi-directional movements, utilizing the progressive pattern design and the track anchoring system. Athletic performance and stamina are enhanced through unique programming based on time, distance covered and specific resistance techniques utilizing bodyweight, barriers and the adjustable track anchoring system. The pattern detailed in FIG. 8 has three specific skill (intensity) ranges:

Level 1 (902)—Targets 852-866

Level 2 (904)—Targets 868-882

Level 3 (906)—Targets 884-898

The training routine follows 3 levels of floor work integration to maximize the potential of the individual. The plyometric fitness platform has calibrated the specific distance from each symbol for intelligent advancement, which is based on 3 specific markers:

1. Body control
2. Speed and accuracy
3. Ability to perform complex, multi-directional movements Individuals are utilizing the system are encouraged to train using the progressive sequence within each level. Specific challenges may be overcome or adapted to by each individual throughout the training, and may require either movement to the next level, or more time on the current level.

The following example is illustrates a multi-stage (multi-level) plyometric fitness routine:

Pattern drills without elastic resistance (Double and Single-Leg)

Pattern drills with elastic resistance cords (Double and Single-Leg)

Pattern drills with barrier (Double and Single-Leg)

Pattern drills with elastic resistance cords and barriers (Double and Single-Leg)

Example 1

Level 1 Programming

| Pattern Drill | Sets | Time |
|---|---|---|
| Level 1 - Day #1 | *Emphasis on double-leg quickness | |
| ●850-▲866-●850-▲862●850 | -2- | :20 |
| ●850-▲860-●850-▲864●850 | -2- | :20 |
| ▲860-▲862-▲864-▲866 | -2- | :20 |
| ●850-●852-●850-●854 | -4- | :15 |
| ▲866-▲860-▲862 | -2- | :15 |
| ●852-●854-●856-●858 (Clockwise) | -1- | :15 |
| ●852-●858-●856-●854 (Counterclockwise) | -1- | :15 |
| BW Squat Jump | -3- | 8 Reps |
| Level 1 - Day #2 | *Add Medial Cord-load during patterns and Squat Jumps | |
| ●850-▲866-●850-▲862●850 | -2- | :15 |
| ●850-▲860-●850-▲864●850 | -2- | :15 |
| ▲860-▲862-▲864-▲866 | -2- | :10 |
| ●850-●852-●850-●854 | -4- | :10 |
| ▲866-▲860-▲862 | -2- | :10 |
| ●852-●854-●856-●858 (Clockwise) | -1- | :10 |
| ●852-●858-●856-●854 (Counterclockwise) | -1- | :10 |
| ●850-●852 (left leg) ●856-●856(Right leg)● ●850-●854 (left leg) ●856-●858(Right leg)● | -2- | :10 |
| ●850-●852 (left leg), 854(Right leg)-●850 ●850-●858 (left leg), 856(Right leg)●-●850 | -2- | :10 |
| BW Squat Jump | -3- | 8 Reps |
| Level 1 - Day #3 | *Emphasis on single leg quickness | |
| ●850-▲866-●850-▲862●850 | -2- | :20 |
| ●850-▲860-●850-▲864●850 | -2- | :20 |
| ●850-▲866-●850-▲862●850 (Single Leg) | -2- | :10 |
| ●850-▲860-●850-▲864●850 (Single Leg) | -2- | :10 |
| ▲860-▲862-▲864-▲866 | -2- | :15 |
| ▲860-▲862-▲864-▲866 (Single Leg) | -2- | :10 |
| ●850-●852-●850-●854 | -2- | :15 |
| ▲866-▲860-▲862 | -1- | :15 |
| ▲866-▲860-▲862 (Singe Leg) | -2- | :10 |
| ●852-●854-●856-●858 (Clockwise) | -1- | :15 |
| ●852-●858-●856-●854 (Counterclockwise) | -1- | :15 |
| BW Squat Jump | -3- | 8 Reps |

The platforms utilized in the plyometric fitness platform system are typically made of ¾" maple hardwood with plywood backers for building up the heights to match any size floor over ¾". For the platforms themselves a variety of materials may be utilized including wood and wood-based products (maple, oak, hickory, bamboo, cork or the like), rubber (any type of general-purpose synthetic rubber, e.g., styrene-butadiene rubber), plastic or polymer (synthetic or semi-synthetic organics, polyurethane or the like), vinyl (solid vinyl, vinyl composition, as well as homogeneous, inlaid, and layered composite sheet flooring or the like), linoleum, laminate (plywood, medium or high density fiberboard "MDF" core with a polymer laminate top layer or the like) or any other material suitable for flooring that is ⅜" or higher. Additionally these materials may be used for inlayed plyometric platforms and floors as well and any combination of the above materials may be contemplated by this disclosure.

Various materials utilized in constructing or coating the exercise platforms 102, 402 may be utilized based upon their elastic properties (bounce and impact absorption) as well as their traction (grip) properties maximizing performance and/or minimizing joint impact and stress. A platform maintaining properties of stability, resiliency, traction, aesthetics, and shock absorbency is often utilized to provide a system that allows the user to receive maximum performance in a safe and economical manner.

The anchor tracking is unpainted extruded aluminum and cut to length for specific application. The lateral platforms 104, 106 are also known as drop zones, and are typically ¾" black rubber areas that are placed on both sides of the center platform surface 102 if the apparatus is also to be utilized for lifting weights. This rubber area is the spot where the actual weights are dropped if the platform is being used for Olympic lifting for example.

The plyometric fitness platforms are typically placed in a plurality of fitness stations which are often constructed as inlayed areas or as above ground platform stations in a weight room type setting. These inlayed plyometric floors can be any custom size, and often include a single exercise pattern 120, 420 throughout the workout center, or may contain a variety of patterns each at a different station.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. A plyometric fitness system for facilitating constrained multi-directional movements of a user comprising:

a training platform placed on or within a floor section upon which the user is able to stand and perform multi-directional exercise movements;

at least one track anchoring system fixated adjacent to said training platform, said at least one track anchoring system comprising a plurality of openings wherein said plurality of openings being arranged sequentially along said at least one track anchoring system;

at least one elastic cord that attaches on a proximal end to a body attachment strap configured to attach to a body part of said user, and at a distal end to said at least one track anchoring system;

at least one quick-release anchor that facilitates adjustable attachment at multiple points on said at least one track anchoring system to provide fixation of said distal end of said at least one elastic cord with respect to said training platform, thereby providing said constraint for said multi-directional exercise movements of the user, said at least one quick-release anchor comprising a fixator placeable within one of said plurality of openings in said at least one track anchoring system;

an exercise pattern design on said training platform that comprises a plurality of targets that are visible to the user during said multi-directional exercise movements, said plurality of targets that act as start-points or end-points for said body part of said user undertaking said movements; and a pair of lateral platforms placed on opposing sides of said training platform, said pair of lateral platforms that provide a surface that is different in surface structure than said training platform.

2. The plyometric fitness system of claim 1, wherein said plyometric fitness system further comprises:

a predetermined program of consecutive body movements configured to utilize said multi-directional exercise movements that are performed by said user that coordinate and sequence elastically constrained jumping movements between said plurality of targets utilizing said at least one elastic cord as said constraint, said predetermined program that incorporates a forced eccentric contraction to muscles which is immediately shifted to a concentric contraction as said user performs jumping movements.

3. The plyometric fitness system of claim 1, wherein said training platform further comprises:

a wooden platform flanked on at least one side by said at least one anchor track.

4. The plyometric fitness system of claim 1, wherein said training platform further comprises:

a solid rubber platform flanked on at least one side by said at least one track anchoring system.

5. The plyometric fitness system of claim 1, wherein said training platform further comprises:

a multi-layer composite platform flanked on at least one side by said at least one anchor track, wherein said multi-layer composite comprises layers chosen from the group consisting of: wood, wood laminate, plywood, medium density fiberboard, high density fiberboard, wood-based products, natural rubber, synthetic rubber, plastic, synthetic polymer, semi-synthetic organic polymer, polymer laminate, polyurethane, vinyl, solid vinyl, vinyl composition, homogeneous composite sheet flooring, inlaid composite sheet flooring, layered composite sheet flooring, and linoleum.

6. The plyometric fitness system of claim 1, wherein said at least one elastic cord further comprises:

an elastic member that provides stretching capability encased within a fabric sleeve;

a first connector secured at said proximal end of said at least one elastic cord to facilitate attachment of said body attachment strap; and, a second connector secured at said distal end of said at least one elastic cord to facilitate attachment to said at least one quick-release anchor.

7. The plyometric fitness system of claim 1, wherein said at least one elastic cord comprises a plurality of cords positioned to provide symmetrical constraint in the form of elastic resistance to said multi-directional exercise movements of said user away from said start-points on said exercise pattern design.

8. The plyometric fitness system of claim 1, wherein said plurality of targets are laid out having multiple successive levels of effort.

9. A plyometric fitness system for facilitating constrained multi-directional movements of a user comprising:

a training platform placed on or within a floor section upon which the user is able to stand and perform multi-directional exercise movements, said training platform that incorporates at least one anchor track system fixated adjacent to said training platform, said at least one anchor track system comprising at least one multi-point quick release attachment point in a linear manner flanking at least one side of said training platform, wherein said at least one multi-point quick release attachment point comprises a plurality of openings;

at least one elastic cord that provides stretching capability encased within a fabric sleeve and attaches with a first connector at a proximal end to a body attachment strap configured to be affixable to said user, and attaches with a second connector at a distal end to said track anchoring system via at least one quick-release anchor, said at least one quick-release anchor that facilitates adjustable attachment to at least one of said at least one multi-point quick release attachment points on said at least one anchor track system to provide fixation of said distal end of said at least one elastic cord with respect to said training platform, said at least one quick-release anchor comprising a fixator placeable within one of said plurality of openings in said at least one track anchoring system;

an exercise pattern design on said training platform that comprises a plurality of targets that are visible to the user during said multi-directional exercise movements, said plurality of targets that act as start-points or end-points for body parts of said user undertaking said multi-directional exercise movements;

a predetermined program of body movements that are performed by said user that coordinate and sequence elastically constrained jumping movements between said plurality of targets utilizing said at least one elastic cord as said constraint, said predetermined program that incorporates a forced eccentric contraction to muscles which is immediately shifted to a concentric contraction as said user performs said jumping movements; and a pair of lateral platforms placed on opposing sides of said training platform, said lateral platforms that provide a surface that is different in surface structure than said training platform.

10. The plyometric fitness system of claim 9, wherein said training platform further comprises:

a wooden platform flanked on at least one side by said at least one anchor track.

11. The plyometric fitness system of claim 9, wherein said training platform further comprises:

a solid rubber platform flanked on at least one side by said at least one anchor track.

12. The plyometric fitness system of claim 9, wherein said training platform further comprises:

a multi-layer composite platform flanked on at least one side by said at least one anchor track, wherein said multi-layer composite comprises layers chosen from the group consisting of: wood, wood laminate, plywood, medium density fiberboard, high density fiberboard, wood-based products, natural rubber, synthetic rubber, plastic, synthetic polymer, semi-synthetic organic polymer, polymer laminate, polyurethane, vinyl, solid vinyl, vinyl composition, homogeneous composite sheet flooring, inlaid composite sheet flooring, layered composite sheet flooring, and linoleum.

13. The plyometric fitness system of claim 9, wherein said plurality of targets are laid out having multiple successive levels of effort.

14. A method of enhancing performance capabilities of a user by performing constrained multi-directional exercise movements utilizing a plyometric fitness system comprising the steps:

supplying a training platform on or within a floor section upon which said user is able to stand and perform multi-directional exercise movements;

supplying an exercise pattern design on said training platform that comprises a plurality of targets that are visible to the user during said multi-directional exercise movements;

elastically constraining said user to at least one track anchoring system fixated adjacent to said training platform with at least one elastic cord comprising the steps:

attaching a proximal end of said at least one elastic cord to a body attachment strap;

fixating said body attachment strap to a body part of said user;

attaching a distal end of said at least one elastic cord to said at least one track anchoring system with at least one quick-release anchor that facilitates adjustable attachment at multiple sequential openings on said track anchoring system to provide fixation of said distal end of said at least one elastic cord with respect to said training platform, said at least one quick-release anchor comprising a fixator placeable within one of said multiple sequential openings in said at least one track anchoring system thereby constraining for said multi-directional exercise movements of said user; and, performing a series of predetermined plyometric movement drills initiating at start-points within said exercise pattern design, said series of predetermined plyometric movement drills comprising a program of consecutive body movements that coordinate and sequence elastically constrained jumping movements between said plurality of targets utilizing said at least one elastic cord as a constraint;

forcing an eccentric contraction to muscles of said user and then immediately shifting to a concentric contraction as said user performs said elastically constrained jumping movements; and supplying said exercise pattern design with multiple successive levels of effort.

15. The method of claim 14, further comprising the step:

placing one or more vertical obstacles on a surface of the training platform to provide additional challenge for the user during performance of said series of predetermined plyometric movement drills.

16. The method of claim 14, wherein said at least one elastic cord comprises a plurality of elastic cords, said method further comprising the step:

attaching said plurality of elastic cords and positioning said elastic cords to provide symmetrical constraint in the form of elastic resistance to said multi-directional exercise movements of said user away from said start-points on said exercise pattern design.

* * * * *